US010175600B1

(12) United States Patent
Kinuta

(10) Patent No.: US 10,175,600 B1
(45) Date of Patent: Jan. 8, 2019

(54) CHARGING MEMBER, CHARGING DEVICE, PROCESS CARTRIDGE, AND IMAGE FORMING APPARATUS

(71) Applicant: FUJI XEROX CO., LTD., Tokyo (JP)

(72) Inventor: Yasuhiko Kinuta, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/916,240

(22) Filed: Mar. 8, 2018

(30) Foreign Application Priority Data

Sep. 6, 2017 (JP) ..... 2017-171472

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 15/0808; G03G 15/0818; G03G 15/1685; G03G 21/0058; G03G 2215/021; G03G 2215/0861; G03G 2215/1614; G03G 2221/0089
USPC ..... 399/176, 279, 286, 313, 357; 492/18, 28
See application file for complete search history.

(56) References Cited

U.S. PATENT DOCUMENTS

| | | | | |
|---|---|---|---|---|
| 7,869,743 | B2 * | 1/2011 | Kagawa | G03G 15/0233 399/174 |
| 9,746,792 | B1 * | 8/2017 | Hayashi | G03G 15/0233 |
| 9,753,391 | B1 * | 9/2017 | Narita | G03G 15/0233 |
| 9,817,328 | B2 * | 11/2017 | Miura | G03G 15/0233 |
| 2016/0154323 | A1 * | 6/2016 | Nishioka | G03G 15/1685 492/18 |
| 2018/0231907 | A1 * | 8/2018 | Kinuta | G03G 15/0233 |

FOREIGN PATENT DOCUMENTS

| | | | | |
|---|---|---|---|---|
| JP | 07049605 | A * | 2/1995 | G03G 15/0233 |
| JP | 08069154 | A * | 3/1996 | |
| JP | 2007225995 | A * | 9/2007 | |
| JP | 2007232861 | A * | 9/2007 | |
| JP | 2008233442 | A * | 10/2008 | |
| JP | 2016141128 | | 8/2016 | |

* cited by examiner

*Primary Examiner* — Robert Beatty
(74) *Attorney, Agent, or Firm* — JCIPRNET

(57) ABSTRACT

A charging member includes a cylindrical or columnar conductive substrate, an elastic layer provided on the conductive substrate, and a surface layer provided on the elastic layer. When in analysis of a circumferential direction period of a surface shape of the elastic layer, a maximum amplitude value in a period region of less than 5 mm is Ae, and when in analysis of a circumferential direction period of a surface shape of the surface layer, a maximum amplitude value in the period region of less than 5 mm is As, the charging member satisfies As/Ae≤0.9.

15 Claims, 9 Drawing Sheets

CHARGING MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-171472 filed Sep. 6, 2017.

BACKGROUND

(i) Technical Field

The present invention relates to a charging member, a charging device, a process cartridge, and an image forming apparatus.

(ii) Related Art

In an image forming apparatus using an electrophotographic system, first a latent image is formed, by charging using a charging device, on the surface of an image holding member including a photoconductive photoreceptor made of an inorganic or organic material, and then the latent image is developed with a charged toner to form a visualized toner image. Then, the toner image is transferred to a recording medium such as recording paper or the like directly or through an intermediate transfer body, and is fixed to the recording member to form an intended image.

SUMMARY

According to an aspect of the invention, there is provided a charging member including a cylindrical or columnar conductive substrate, an elastic layer provided on the conductive substrate, and a surface layer provided on the elastic layer. When in analysis of a circumferential direction period of a surface shape of the elastic layer, a maximum amplitude value in a period region of less than 5 mm is Ae, and when in analysis of a circumferential direction period of a surface shape of the surface layer, a maximum amplitude value in the period region of less than 5 mm is As, the charging member satisfies As/Ae≤0.9.

BRIEF DESCRIPTION OF THE DRAWINGS

Exemplary embodiments of the present invention will be described in detail based on the following figures, wherein.

DETAILED DESCRIPTION

An exemplary embodiment of the present invention is described below.

[Charging Member]

A charging member according to an exemplary embodiment of the invention includes a cylindrical or columnar conductive substrate, an elastic layer provided on the conductive substrate, and a surface layer provided on the elastic layer. When in analysis of a circumferential direction period of a surface shape of the elastic layer, a maximum amplitude value in a period region of less than 5 mm is Ae, and when in analysis of a circumferential direction period of a surface shape of the surface layer, a maximum amplitude value in the period region of less than 5 mm is As, the charging member satisfies As/Ae≤0.9.

The charging member according to the exemplary embodiment of the invention is, for example, disposed in contact with a body to be charged (for example, an image holding member) and the body to be charged is contact-charged by applying a voltage to the charging member.

In the specification of the present invention, the term "conductive" represents that a volume resistivity at 20° C. is $1\times10^{14}$ Ωcm or less.

When the charging member disposed in contact with the surface of the image holding member has a poor surface shape in the circumferential direction, the image holding member vibrates with rotation of the charging member. The vibration of the image holding member may cause variation in a position (write-in position) where a latent image is formed by an exposure device, thereby causing density unevenness of the image. In particular, when the charging member and the exposure device using a light emitting diode as a light source are integrally held in a housing, vibration of the charging member is propagated to the exposure device through the housing and thus causes variation in the position (write-in position) where a latent image is formed by the exposure device, thereby easily causing density unevenness of the image.

Therefore, when in analysis of the circumferential direction period of the surface shape of the elastic layer, the maximum amplitude value in a period region of less than 5 mm is Ae, and when in analysis of the circumferential direction period of the surface shape of the surface layer, the maximum amplitude value in a period region of less than 5 mm is As, the charging member according to the exemplary embodiment satisfies As/Ae≤0.9. It is thus supposed that vibration of the image holding member with rotation of the charging member is suppressed, and vibration-associated variation in the position (write-in position) where the latent image is formed by the exposure device is suppressed.

It is thus supposed to provide a charging member in which density unevenness of the resultant image is suppressed by suppressing variation in the position (write-in position) where the latent image is formed by the exposure device.

The charging member according to the exemplary embodiment is described below with reference to the drawings.

Figure 1:
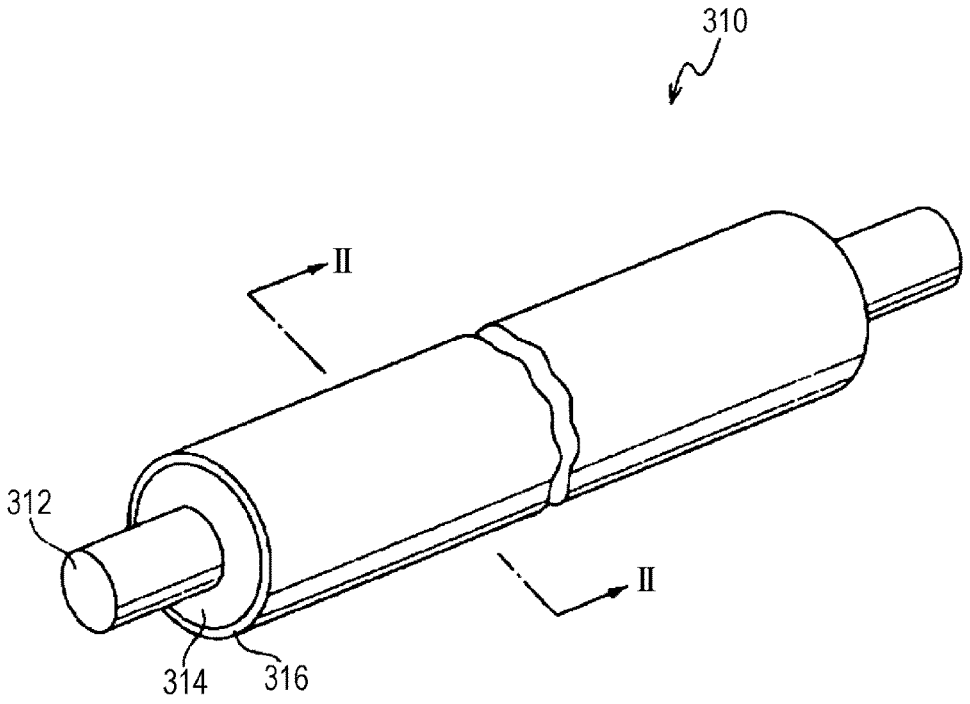
FIG. 1 is a schematic perspective view showing a charging member according to an exemplary embodiment.
Figure 2:
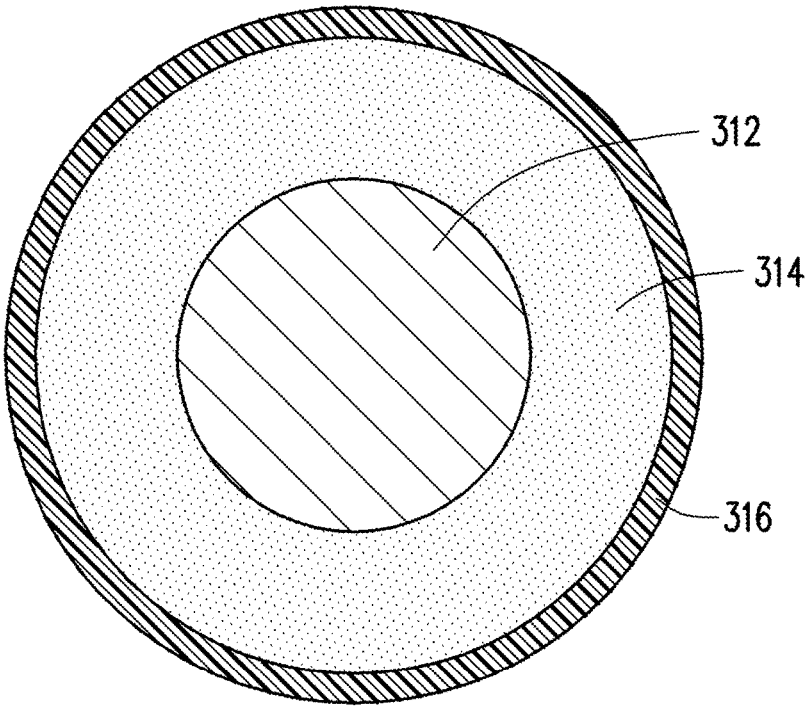
FIG. 2 is a schematic sectional view showing the charging member according to the exemplary embodiment.

FIG. 1 is a schematic perspective view showing the charging member according to the exemplary embodiment. FIG. 2 is a schematic sectional view showing the charging member according to the exemplary embodiment. In addition, FIG. 2 is a sectional view taken along line II-II in FIG. 1.

As shown in FIGS. 1 and 2, a charging member 310 according to the exemplary embodiment is a roller member including, for example, a cylindrical or columnar conductive substrate 312 (shaft), an elastic layer 314 disposed on the outer peripheral surface of the conductive substrate 312, and a surface layer 316 disposed on the outer peripheral surface of the elastic layer 314.

The configuration of the charging member 310 according to the exemplary embodiment is not limited to the above and, for example, the configuration may not include the surface layer 316. That is, the charging member 310 according to the exemplary embodiment may include only the conductive substrate 312 and the elastic layer 314.

Also, the charging member 310 may have a configuration including an intermediate layer (for example, an adhesive layer) disposed between the elastic layer 314 and the conductive substrate 312 and a resistance-adjusting layer or transfer-preventing layer disposed between the elastic layer 314 and the surface layer 316.

Details of the charging member 310 according to the exemplary embodiment are described below. In the description below, reference numerals are omitted.

When in analysis of the circumferential direction period of the surface shape of the elastic layer, the maximum amplitude value in a period region of less than 5 mm is Ae, and when in analysis of the circumferential direction period of the surface shape of the surface layer, the maximum amplitude value in a period region of less than 5 mm is As, the charging member according to the exemplary embodiment satisfies $As/Ae \leq 0.9$. From the viewpoint of suppressing density unevenness of the image, the charging member according to the exemplary embodiment preferably satisfies $0.5 \leq As/Ae \leq 0.9$, more preferably satisfies $0.55 \leq As/Ae \leq 0.87$, still more preferably satisfies $0.60 \leq As/Ae \leq 0.84$, and particularly preferably satisfies $0.70 \leq As/Ae \leq 0.80$.

In analysis of the circumferential direction period of the surface shape of the elastic layer, from the viewpoint of suppressing density unevenness of the image, the maximum amplitude value Ae in a period region of less than 5 mm is preferably 0.3 μm or more and 1.0 μm or less, more preferably 0.5 μm or more and 1.0 μm or less, and particularly preferably 0.6 μm or more and 0.9 μm or less.

In analysis of the circumferential direction period of the surface shape of the surface layer, from the viewpoint of suppressing density unevenness of the image, the maximum amplitude value As in a period region of less than 5 mm is preferably 0.2 μm or more and 0.9 μm or less, more preferably 0.4 μm or more and 0.9 μm or less, and particularly preferably 0.5 μm or more and 0.8 μm or less.

In the charging member according to the exemplary embodiment, the analysis of the circumferential direction period of the surface shape of the surface layer is performed by the following method.

First, the outer shape of each of nine sections (sections formed by cutting the charging member in a direction perpendicular to the axial direction thereof) is measured by using a roundness/cylindrical shape measuring device at intervals formed by dividing the whole length (whole length=length in the axial direction of the charging member) of the surface layer of the charging member into nine equal parts. Based on the measurement, the amplitudes of the outer shapes of the sections of the charging member are determined. Conditions for measuring the outer shapes of the sections of the charging member are as follows.

Roundness/cylindrical shape measuring device: model RondCom 60A, manufactured by Tokyo Seimitsu Co., Ltd.

Detector: low-pressure detector for RondCom 60A (model: E-DT-R87A, manufactured by Tokyo Seimitsu Co., Ltd.)

Waviness stylus: waviness stylus for RondCom 60A (model: 0102505, manufactured by Tokyo Seimitsu Co., Ltd.)

Measurement magnification: 500 times

Measurement speed: 4/min

Center method: LSC

Filter: 2RC

Cutoff: Low

Data extraction pitch: 0.1°

Next, after the measurement of the outer shapes of the sections of the charging member, the amplitudes corresponding to 5 rounds around the circumference of the outer shape of each of the sections of the charging member are connected, and analysis of the period is performed by fast Fourier transform (FFT) using the data of 16384 connected points. The amplitude values measured in each of the nine sections are averaged for each of the periods and used as the amplitude value of each of the periods of the charging member.

Then, in the analysis of the circumferential direction period of the surface shape of the surface layer, the maximum amplitude value within a period region of less than 5 mm is determined.

Also, in the analysis of the circumferential direction period of the surface shape of the elastic layer in the charging member according to the exemplary embodiment, the elastic layer is exposed by removing the surface layer by wiping off with a solvent (for example, methanol), and the analysis of the period of the exposed elastic layer is performed by the same method as for the analysis of the circumferential direction period of the surface shape of the surface layer described above.

The surface shape characteristics of the elastic layer and the surface layer in the charging member are controlled by conditions of a method for producing the charging member (for example, a method for forming the elastic layer) described below.

When in the charging member according to the exemplary embodiment, the MD-1 hardness of the elastic layer in a state where the elastic layer is provided on the conductive substrate is He, and the MD-1 hardness of the surface layer in a state where the elastic layer and the surface layer are provided in turn on the conductive substrate is Hs, from the viewpoint of suppressing density unevenness of the image, $Hs/He \leq 1.2$ is preferably satisfied, and $Hs/He \leq 1.3$ is more preferably satisfied.

Also, from the viewpoint of suppressing density unevenness of the image, the charging member according to the exemplary embodiment more preferably satisfies $1.20\ Hs/He \leq 1.50$, still more preferably satisfies $1.22\ Hs/He \leq 1.45$, and particularly preferably satisfies $1.30 \leq Hs/He \leq 1.40$.

From the viewpoint of suppressing density unevenness of the image, the value of MD-1 hardness He of the elastic layer is preferably 20 or more and 60 or less, more preferably 30 or more and 50 or less, still more preferably 35 or more and 50 or less, and particularly preferably 40 or more and 50 or less.

From the viewpoint of suppressing density unevenness of the image, the value of MD-1 hardness Hs of the surface layer is preferably 30 or more and 90 or less, more preferably 40 or more and 80 or less, still more preferably 50 or more and 70 or less, and particularly preferably 55 or more and 65 or less.

In the exemplary embodiment, the "MD-1 hardness" is the value (hardness) measured by using a MD-1 hardness tester manufactured by Kobunshi Keiki Co., Ltd. of type A for general rubber. In the hardness tester manufactured by Kobunshi Keiki Co., Ltd., when a cylindrical pressure needle having a diameter of 0.16 mm and a height of 0.5 mm is pressed on a sample regarded as having hardness 0 with a load of 22 mN by using a cantilever spring, the displacement of the spring is regarded as a reference displacement. When the pressure needle is pressed with a load of 332 mN by using the spring, the hardness of an object showing the same displacement of the spring as the reference displacement is defined to be 100.

In the exemplary embodiment, the MD-1 hardness of the surface layer is measured by a method using MD-1 capa type-A manufactured by Kobunshi Keiki Co., Ltd. The hardness is measured in a normal measurement mode with a timer set to 2 seconds at a total of three measurement positions including a center position and positions at 20 mm from both ends of the elastic layer of the charging member. The hardness is calculated by averaging the values at three measurement positions.

In the exemplary embodiment, the MD-1 hardness of the elastic layer is measured by a method in which the elastic layer is exposed by removing the surface layer by wiping with a solvent and then the hardness of the exposed elastic layer is measured by the same measurement method as for the MD-1 hardness of the surface shape of the surface layer.

Details of each of the members of the charging member according to the exemplary embodiment are described below.

(Conductive Substrate)

The conductive substrate is described.

The conductive substrate used is made of, for example, a conductive material such as a metal or alloy, such as aluminum, a copper alloy, stainless steel, or the like; iron plated with chromium, nickel, or the like; a conductive resin, or the like.

The conductive substrate functions as an electrode and a support member of a charging roller, and examples of the material thereof include metals such as iron (free-cutting steel or the like), copper, brass, stainless, aluminum, nickel, and the like. Examples of the conductive substrate include a member (for example, a resin member, a ceramic member, or the like) having a plated external peripheral surface, a member (for example, a resin member, a ceramic member, or the like) containing a conductive agent dispersed therein, and the like. The conductive substrate may be a hollow member (cylindrical member) or a non-hollow member.

(Elastic Layer)

The elastic layer is described.

The elastic layer is a conductive layer containing, for example, an elastic material and a conductive agent. If required, the elastic layer may contain other additives.

Examples of the elastic material include isoprene rubber, chloroprene rubber, epichlorohydrin rubber, butyl rubber, polyurethane, silicone rubber, fluorocarbon rubber, styrene-butadiene rubber, butadiene rubber, nitrile rubber, ethylene-propylene rubber, epichlorohydrin-ethylene oxide copolymer rubber, epichlorohydrin-ethylene oxide-ally glycidyl ether copolymer rubber, ethylene-propylene-diene terpolymer rubber (EPDM), acrylonitrile-butadiene copolymer rubber (NBR), natural rubber, a rubber mixture thereof, and the like. Among these, preferred are polyurethane, silicone rubber, EPDM, epichlorohydrin-ethylene oxide copolymer rubber, epichlorohydrin-ethylene oxide-ally glycidyl ether copolymer rubber, NBR, a rubber mixture thereof, and the like. These elastic materials may be foamed or not be foamed.

Examples of the conductive agent include an electronic conductive agent, and an ionic conductive agent, and the like.

Examples of the electronic conductive agent include powders of carbon black such as Ketjen black, acethylene black, and the like; various conductive metals or alloys such as pyrolytic carbon, graphite, aluminum, copper, nickel, stainless steel, and the like; various conductive metal oxides such as tin oxide, indium oxide, titanium oxide, tin oxide-antimony oxide solid solution, tin oxide-indium oxide solid solution, and the like; insulating materials having conductive surfaces; and the like.

Examples of the ionic conductive agent include perchlorates and chlorates of tetraethylammonium, lauryl trimethylammonium, and the like; perchlorates and chlorates of alkali metals and alkaline earth metals such as lithium, magnesium, and the like; and the like.

These conductive agents may be used alone or in combination of two or more.

Specific examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" which are manufactured by Orion Engineered Carbons Co., Ltd., "MONARCH 1000", "MONARCH 1300", "MONARCH 1400", "MOGUL-L", and "REGAL 400R" which are manufactured by Cabot Corporation, and the like.

The average particle diameter of the conductive agent is preferably 1 nm or more and 200 nm or less.

The average particle diameter is calculated by averaging the diameters (maximum diameters) of 100 conductive agent particles measured by electron microscope observation of a sample cut out from the elastic layer. Also, the average particle diameter may be measured by using, for example, Zetasizer Nano ZS manufactured by Sysmex Corporation.

The content of the conductive agent is not particularly limited, but the content of the electronic conductive agent is preferably within a range of 1 part by weight or more and 30 parts by weight or less and more preferably 15 parts by weight or more and 25 parts by weight or less relative to 100 parts by weight of the elastic material. On the other hand, the content of the ionic conductive agent is preferably within a range of 0.1 parts by weight or more and 5.0 parts by weight or less and more preferably 0.5 parts by weight or more and 3.0 parts by weight or less relative to 100 parts by weight of the elastic material.

Examples of other additives added to the elastic layer include materials which can be generally added to an elastic layer, such as a softening agent, a plasticizer, a curing agent, a vulcanizing agent, a vulcanization accelerator, an antioxidant, a surfactant, a coupling agent, a filler (silica, calcium carbonate, or the like), and the like.

The thickness of the elastic layer is preferably 1 mm or more and 10 mm or less and more preferably 2 mm or more and 5 mm or less.

The volume resistivity of the elastic layer is preferably $10^3$ Ωcm or more and $10^{14}$ Ωcm or less.

The volume resistivity of the elastic layer is a value measured by a method described below.

A sheet-shaped measurement sample is obtained from the elastic layer of the conductive member. By using a measurement jig (R12702A/B resistivity chamber: manufactured by Advantest Corporation) and a high resistance meter (R8340A digital high resistance/micro-current meter: manufactured by Advantest Corporation), according to JIS K 6911 (1995), a voltage adjusted so that an electric field (applied voltage/thickness of composition sheet) is 1000 V/cm is applied to the measurement sample for 30 seconds, and then the volume resistivity is calculated from a flowing current value by using a formula below.

Volume resistivity (Ω·cm)=(19.63×applied voltage (V))/(current value (*A*)×thickness of measurement sample (cm))

(Surface Layer)

The surface layer is, for example, a layer containing a resin. If required, the surface layer may contain other additives or the like.

The surface layer may have the form of a resin layer or the like provided independently on the elastic layer, or the form of a surface layer provided by impregnating, with a resin or the like, the air bubbles in a surface layer portion of the foamed elastic layer (that is, the form of a surface layer portion serving as a surface layer and containing air bubbled impregnated with a resin or the like in the elastic layer).

—Resin—

Examples of the resin include an acrylic resin, a fluorine-modified acrylic resin, a silicone-modified acrylic resin, a cellulose resin, a polyamide resin, copolymer nylon, a polyurethane resin, a polycarbonate resin, a polyester resin, a polyimide resin, an epoxy resin, a silicone resin, a polyvinyl alcohol resin, a polyvinyl butyral resin, a polyvinyl acetal resin, an ethylene tetrafluoroethylene resin, a melamine resin, a polyethylene resin, a polyvinyl resin, a polyarylate resin, a polythiophene resin, a polyethylene terephthalate resin (PET), fluorocarbon resins (a polyvinylidene fluoride resin, a tetrafluoroethylene resin, a tetrafluoroethylene-perfluoroalkyl vinyl ether copolymer (PFA), a tetrafluoroethylene-hexafluoropropylene copolymer (FEP), and the like), and the like. The resin is preferably produced by curing or crosslinking a curable resin with a curing agent or a catalyst.

The copolymer nylon is a copolymer containing as a polymerization unit any one or plural ones of 610 nylon, 11 nylon, and 12 nylon. The copolymer nylon may contain another polymerization unit such as 6 nylon, 66 nylon, or the like.

Among these, from the viewpoint of suppressing contamination of the surface layer, a polyvinylidene fluoride resin, a tetrafluoroethylene resin, and a polyamide resin are preferred as the resin, and the polyamide resin is more preferred. The polyamide resin causes little frictional charging by contact with a body to be charged (for example, the image holding member) and thus the adhesion of toner and an external additive is easily suppressed.

Examples of the polyamide resin include polyamide resins described in "Polyamide Resin Handbook" (Osamu Fukumoto, Nikkan Kogyo Shinbun, Ltd.). Among these, from the viewpoint of suppressing contamination of the surface layer, alcohol-soluble polyamide is particularly preferred as the polyamide resin, alkoxymethylated polyamide (alkoxymethylated nylon) is more preferred, and methoxymethylated polyamide (methoxymethylated nylon) is still more preferred.

In addition, from the viewpoint of improving the mechanical strength of the surface layer and suppressing the occurrence of a crack in the surface layer, the resin may have a crosslinked structure.

The surface layer may contain particles for the purpose of controlling the surface properties of the charging member. Examples of the particles include inorganic particles of silica, alumina, and the like, resin particles such as polyamide resin particles, fluorocarbon resin particles, silicone resin particles, and the like.

From the viewpoint of the surface properties of the charging member, the resin particles are preferred, and the polyamide resin particles are more preferred. The polyamide resin described above is preferred as the polyamide resin of the polyamide resin particles.

The particles other than the conducive particles may be one type or a combination of two or more types.

From the viewpoint of excellent dispersibility in a binder resin, the average primary particle diameter of the resin particles such as polyamide resin particles or the like contained in the surface layer is preferably 3 μm or more and 10 μm or less.

The content of the resin particles such as polyamide resin particles or the like contained in the surface layer is preferably 3 parts by weight or more and 50 parts by weight or less and more preferably 10 parts by weight or more and 30 parts by weight or less relative to 100 parts by weight of the binder resin.

—Other Additives—

Examples of other additives include known additives which are generally added to a surface layer, such as a conductive agent, a filler, a curing agent, a vulcanizing agent, a vulcanization accelerator, an antioxidant, a surfactant, a coupling agent, and the like.

The thickness of the surface layer is preferably 0.01 μm or more and 1,000 μm or less and more preferably 2 μm or more and 25 μm or less.

The thickness of the surface layer is a value measured by the following method. A surface layer section of a sample cut out from the surface layer is observed at 10 points with an electron microscope, and the thickness is calculated by averaging the measured values.

The volume resistivity of the surface layer is preferably within a range of $10^3$ Ωcm or more and $10^{14}$ Ωcm or less.

The volume resistivity of the surface layer is the value measured by the same method as for the volume resistivity of the elastic layer.

(Method for Producing Charging Member)

An example of a method for producing the charging member according to the exemplary embodiment is described below together with an example of a production apparatus used for the production method. In an example of the method for producing the charging member and an example of the production apparatus, for example, surface shape precision of the elastic layer can be improved by adjusting "separation distances K, K2, and K3", "outer diameter ϕ and number of breaker plate holes", "discharge head (die temperature)", etc. described below, thereby providing the surface shape properties of the charging member described above.

In the description below of an example of the method for producing the charging member and an example of the production apparatus used for the production method, the conductive substrate (shaft) is referred to as the "core metal", and the "member (roller)" in which the elastic layer is formed on the conductive substrate is referred to as the "rubber roller".

—Production of Rubber Roller (Formation of Elastic Layer)—

An apparatus 10 for producing the rubber roller is described with reference to FIG. 4. In the figure, an arrow H denotes the vertical direction of the apparatus, and an arrow W denotes the width direction (horizontal direction) of the apparatus.

[Overall Configuration]

The apparatus 10 for producing the rubber roller includes an extruder 12 provided with a so-called crosshead die, a separator 14 disposed below the extruder 12, and a drawer device 16 disposed below the separator 14. The apparatus 10 for producing the rubber roller further includes a cutting machine (not shown).

(Extruder)

The extruder 12 includes a supply part 18 which supplies unvulcanized rubber, an extrusion part 20 which extrudes the rubber supplied from the supply part 18 into a cylindrical shape, and a core metal transport part 24 which supplies a core metal 22 to a central portion of the rubber extruded into a cylindrical shape from the extrusion part 20.

[Supply Part]

The supply part 18 includes a screw 28 disposed in a cylindrical body part 26, a heater (not shown) which heats the rubber in the body part 26, a drive motor 30 disposed on the rear end side (base end part) of the screw 28 in the body part 26 to rotationally drive the screw 28, and a breaker plate 29 disposed on the front end side of the screw 28 in the body part 26. Further, a material inlet 32 which introduces a rubber material 100 is disposed on the drive motor-side of the body part 26.

In the supply part 18, the rubber material 100 (composition containing the components constituting the elastic layer) introduced from the material inlet 32 is transferred to the extrusion part 20 as an example of a discharge part while being kneaded by the screw 28 in the body part 26.

[Extrusion Part]

The extrusion part 20 includes a cylindrical case 34 connected to the supply part 18 and a cylindrical holding member 42 provided inside the case 34. The case 34 has an inlet 102 formed in the side part of the case 34 so as to introduce the rubber material 100 supplied from the supply part 18. Also, a discharge head 38 is held at the lower end of the holding member 42, and the discharge head 38 is held by the case 34 through the holding member 42. The discharge head 38 has a discharge port 104 formed for discharging downward the rubber material 100 introduced into the extrusion part 20.

Further, in the extrusion part 20, a mandrel 36 as an example of a cylindrical flow path-forming part is supported in a state of being inserted into the holding member 42 in the case 34. The mandrel 36 is held by the case 34 through the holding member 42. In addition, a top surface member 106 for fixing the mandrel 36 is provided in an upper portion of the case 34, and an annular flow path 44 through which the rubber material 100 annularly flows is formed between the outer peripheral surface of the mandrel 36 and the inner peripheral surface of the holding member 42.

For example, when the volume of the rubber material 100 supplied to the extrusion part 20 per minute from the supply part 18 is V, the volume of all flow paths constituting the annular flow path 44 formed for the rubber material 100 in the extrusion part 20 is set to 5 V or more and 10 V or less. Each of the flow paths is described in detail in description of the mandrel 36.

[Mandrel]

A passage hole 46 through which the core metal 22 is inserted and passed is formed in a central portion of the mandrel 36. Also, a lower-side part of the mandrel 36 has a shape tapered toward the front end located at the discharge port side in a state where the mandrel 36 is mounted in the extrusion part 20 (hereinafter, also referred to as a "set state of the mandrel 36"). In addition, a lower-side region of the front end of the mandrel 36 serves as a joint region 48 where the core metal 22 supplied from the passage hole 46 is joined to the rubber material supplied from the annular flow path 44. That is, the rubber material 100 is cylindrically extruded to the joint region 48, and the core metal 22 is introduced into the central portion of the cylindrically extruded rubber material 100.

As shown in FIG. 4 to FIG. 9, the mandrel 36 has a disk-shaped base part 110 supported in the state of being surrounded by the case 34, a base end part 112 extending to the front end side from the base part 110, and a front end part 114 extending to the front end side from the base end part 112.

Figure 7:
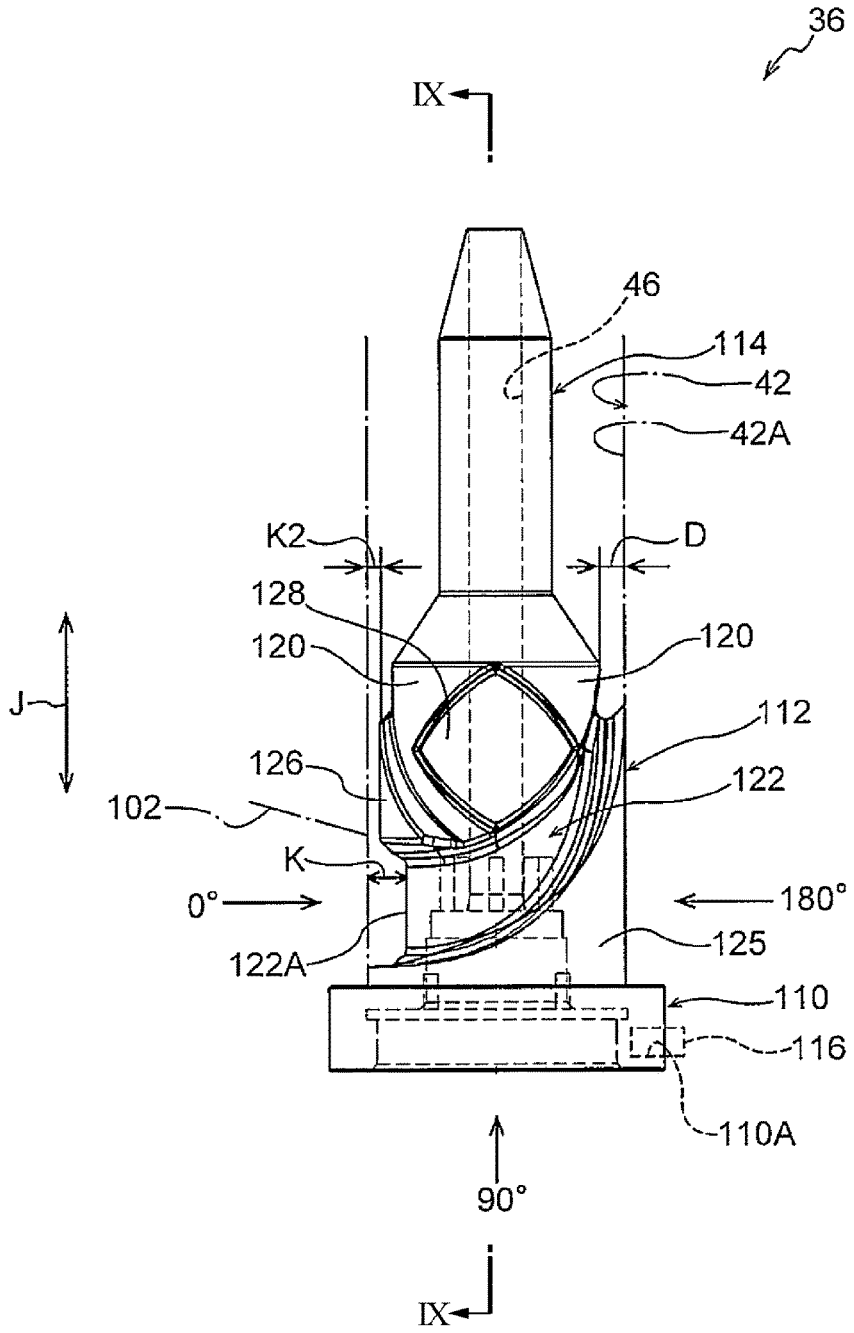
FIG. 7 is a right side view showing the mandrel as an example of the flow path forming part.

In addition, a bottomed-circular hole 110A is formed at a predetermined position of the side surface of the base part 110. As shown in FIG. 7, a positing pin 116 can be inserted in a projecting state into the circular hole 110A. When the positioning pin 116 is set to coincide with a positioning groove (not shown) provided in the extrusion part 20, the mounting position of the mandrel 36 in the circumferential direction is determined with respect to the extrusion part 20.

The base end part 112 is formed in a cylindrical shape which has a smaller diameter than the base part 110 and in which the passage hole 46 (refer to FIG. 9) is passed through a central portion. As shown in FIG. 5 to FIG. 8, reference surfaces 120 are formed on the outer peripheral surface of the base end part 112 so as to form the flow path (annular flow path 44) of the rubber material 100 between the outer peripheral surface of the base end part 112 and the inner peripheral surface 42A of the holding member 42.

Figure 5:
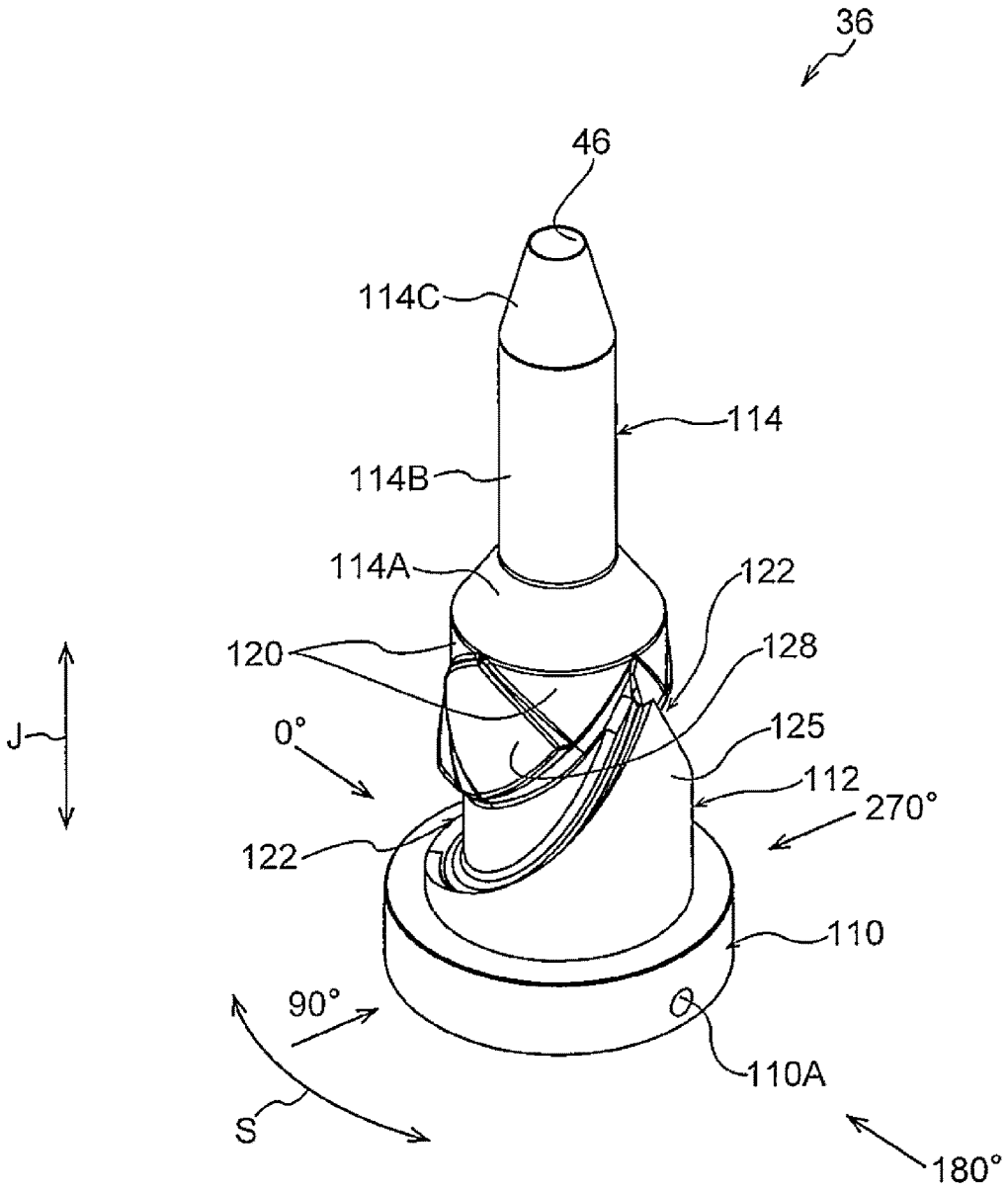
FIG. 5 is a perspective view showing a mandrel as an example of a flow path forming part.
Figure 6:
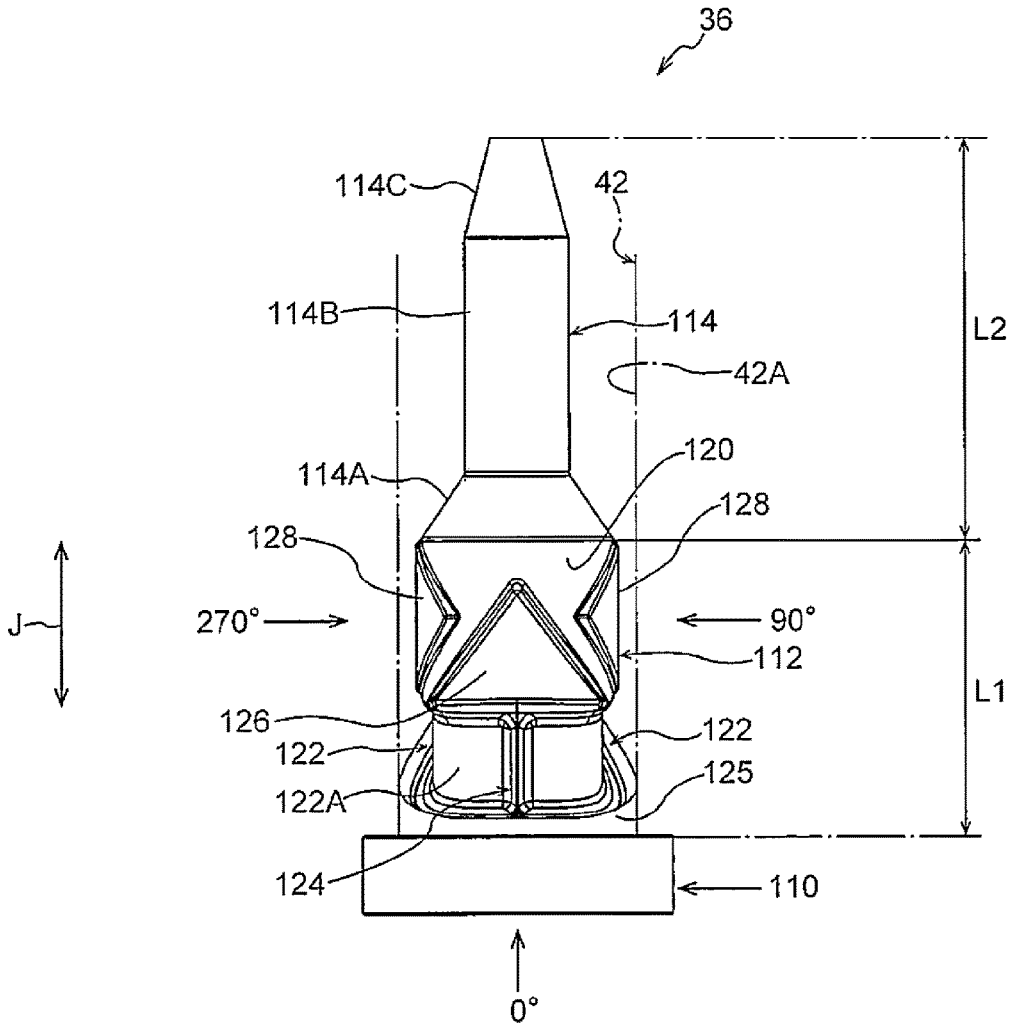
FIG. 6 is a front view showing the mandrel as an example of the flow path forming part.

As shown in FIG. 5 to FIG. 7, in the set state of the mandrel 36, when the position of the reference surface 120 facing the inlet 102 in the axial direction J of the extrusion part 20 is referred to as a "0° position" in the circumferential direction S, grooves 122 are formed on both sides of the base end part 112 so as to extend from the 0° position to the 180° position in the circumferential direction S. In addition, the circular hole 110A is formed at the 180° position in the base part 110.

Figure 8:
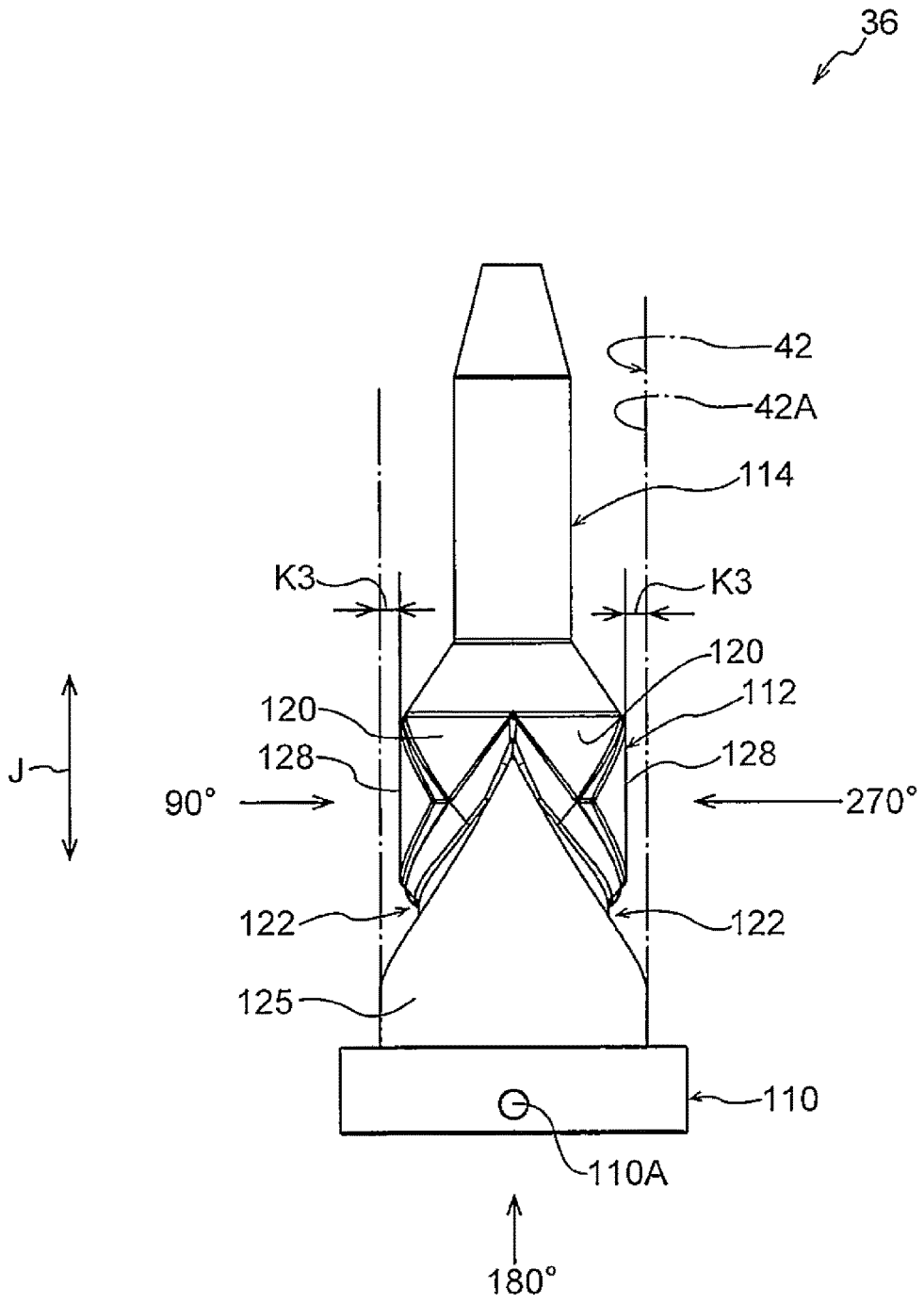
FIG. 8 is a back side view showing the mandrel as an example of the flow path forming part.
Figure 9:
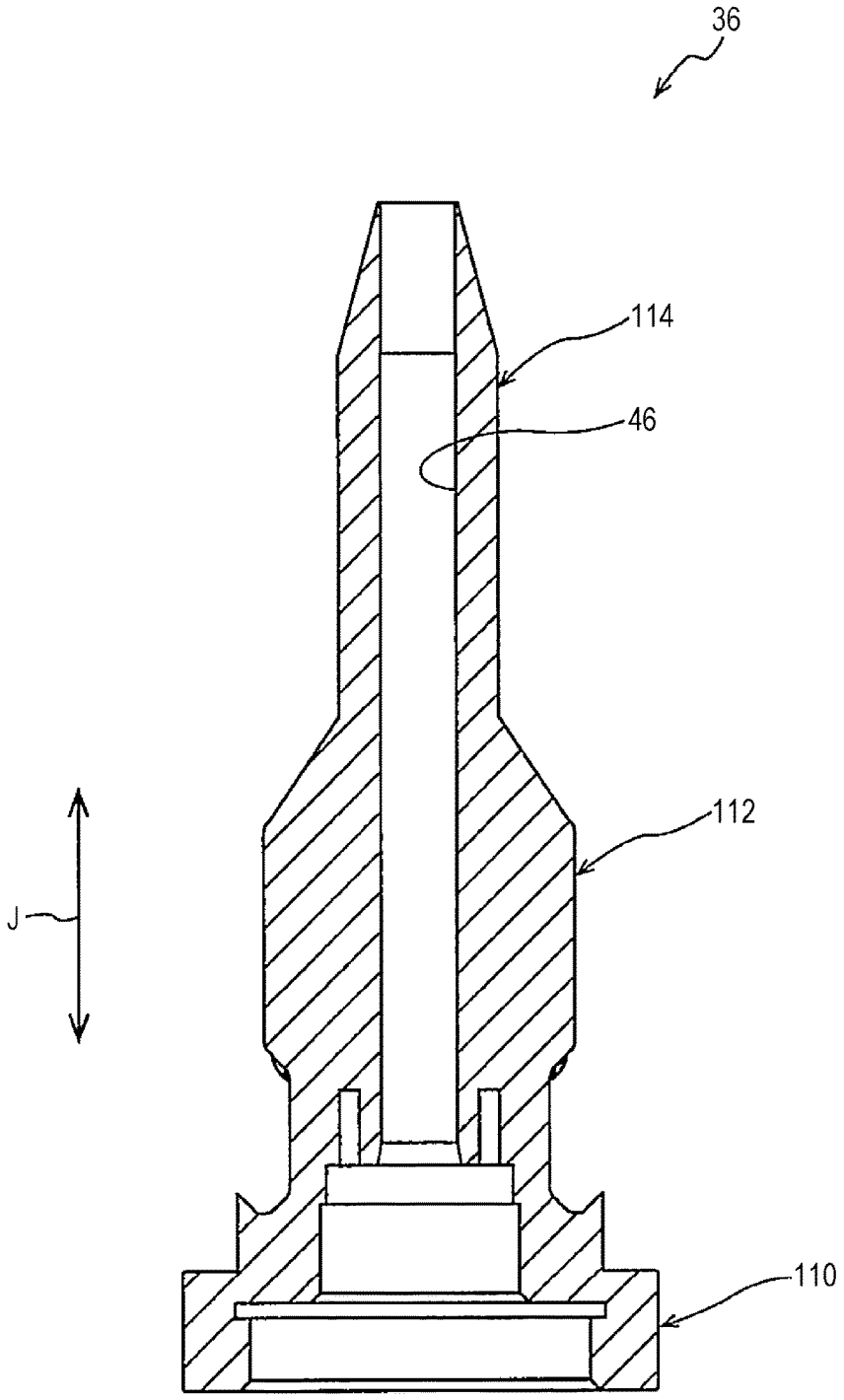
FIG. 9 is a sectional view taken along IX-IX in FIG. 7.

Each of the grooves 122 is inclined from the base end side to the front end side of the mandrel 36 in the direction from the 0° position to the 180° position. As shown in FIG. 5 and FIG. 8, the front ends of the grooves 122 are connected to each other at the 180° position. As shown in FIG. 6, a mount-shaped projection 124 is formed in the groove width direction at the 0° position on the groove bottom 122A of each of the grooves 122. Thus, the rubber material 100 introduced from the inlet 102 can be divided and flowed into the left and right grooves 122 with the projection 124 as a boundary.

As shown in FIG. 7, when the separation distance from each of the reference surfaces 120 to the inner peripheral surface 42A of the holding member 42 is D, each of the grooves 122 is set so that the separation distance K from each of the groove bottoms 122A to the inner peripheral surface 42A falls within a range of 1.1 D to 1.5 D.

In addition, a thick part 125 projecting from the reference surfaces 120 is formed between the grooves 122 and the base part 110. Therefore, the thick part 125 is configurated to fit in the state of adhering to the inner peripheral surface 42A of the holding member 42 in the state where the mandrel 36 is inserted into the holding member 42 of the extrusion part 20.

As shown in FIG. 6, an inlet-side convex surface 126 as an example of a convex surface is formed at least within a range of 0°±10° of the reference surface 120 region on the front end side of the grooves 122. The inlet-side convex surface 126 projects in a triangular shape having an apex on the front end side of the mandrel 36 as seen from the 0° direction. Also, as shown in FIG. 7, the separation distance K2 from the inlet-side convex surface 126 to the inner peripheral surface 42A is set to be 0.5 D to 0.9 D.

Also, as shown in FIG. 6 and FIG. 7, side convex surfaces 128 as an example of a convex surface are formed at least within a range of 90°±10° and at least within a range of 270°±10° of the reference surface 120 region on the front end side of the grooves 122. The side convex surfaces 128 are formed in a rectangular shape as seen from the 90° direction and the 270° direction and are disposed so that one of the sides is placed along the grooves 122 and the opposing corners are directed to the front end side and the base end side. Also, as shown in FIG. 8, the separation distance K3 from each of the side convex surfaces 128 to the inner peripheral surface 42A is set to be 0.5 D to 0.9 D. In addition, the reference surfaces 120 are present between the inlet-side convex surface 126 and the side convex surfaces 128 and on the front end side of the inlet-side convex surface 126 and the side convex surfaces 128.

Therefore, as shown in FIG. 7, a flow path along each of the grooves 122 with the separation distance K and a flow path along the inlet-side convex surface 126 with the separation distance K2 are formed between the base end part 112 of the mandrel 36 and the inner peripheral surface 42A of the holding member 42 of the extrusion part 20. Also, as shown in FIGS. 7 and 8, a flow path along each of the side convex surfaces 128 with the separation distance K3 and a flow path along each of the reference surfaces 120 with the separation distance D are formed between the base end part 112 and the inner peripheral surface 42A.

Also, as shown in FIGS. 5 and 6, the front end part 114 is formed in a cylindrical shape which has a smaller diameter than that of the base end part 112 and has the passage hole 46 (refer to FIG. 9) passing through a central portion and which is rotationally symmetric around the axis. The front end part 114 has a base end-side diameter-reducing part 114A provided on the base end part 112 side and having a diameter reducing toward the front end side, a cylindrical part 114B extending from the base end-side diameter-reducing part 114A to the front end side, and a front end-side diameter-reducing part 114C having a diameter reducing from the cylindrical part 114B to the front-end side.

As shown in FIG. 6, when the length of the base end part 112 in the axial direction is L1 and the length of the front end part 114 is L2, the length of the front end part 114 in the axial direction is set so that the length ratio L1:L2 is within a range of 3:7 to 5:5. That is, the ratio of (length L1 of the base end part 112)/(length L2 of the front end part 114) is 3/7 to 5/5.

[Core Metal Transport Part]

Figure 4:
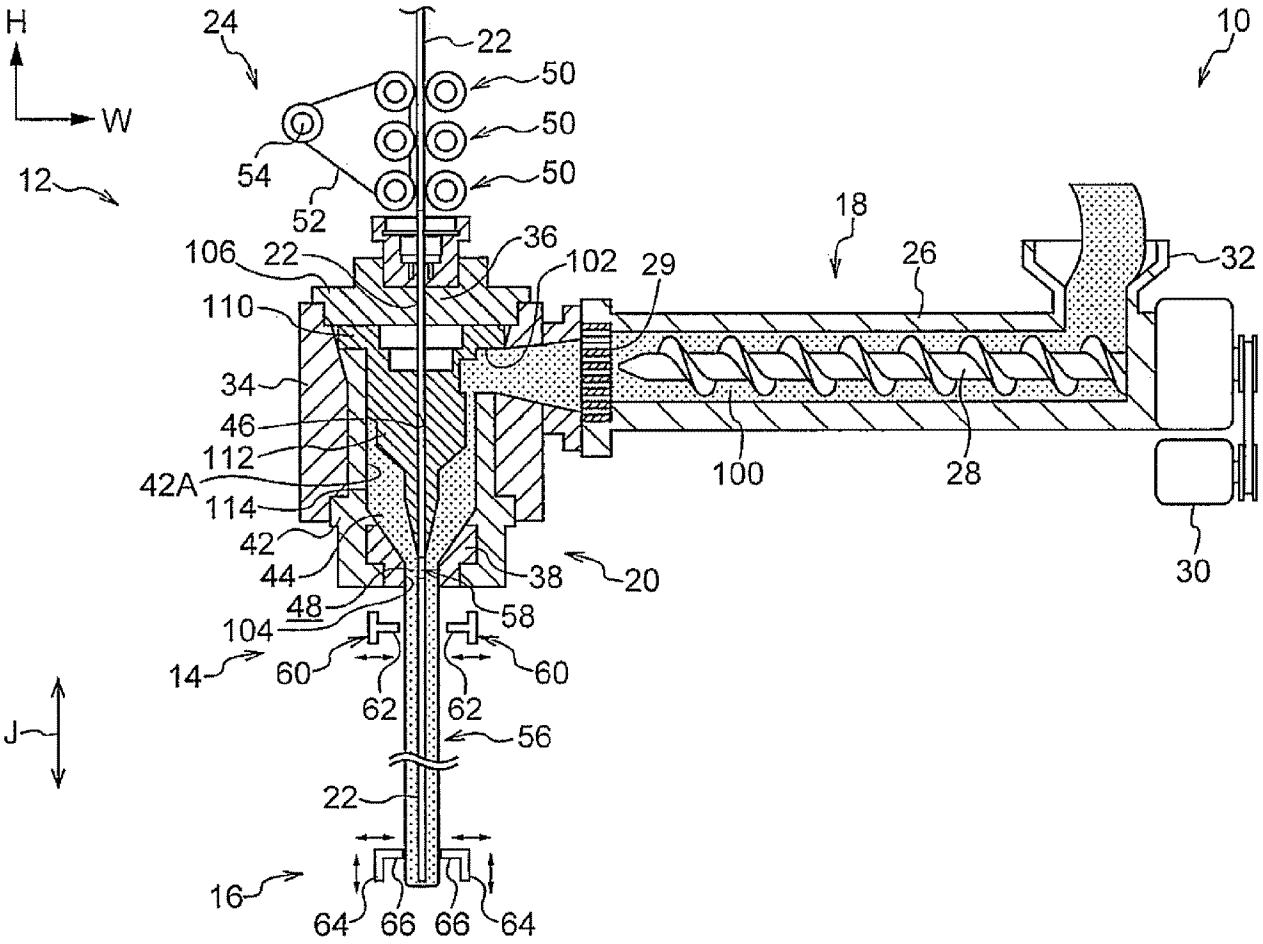
FIG. 4 is a schematic configuration diagram showing an apparatus for producing the charging member (rubber roller) according to the exemplary embodiment.

As shown in FIG. 4, the core metal transport part 24 is provided with roller pairs 50 disposed on the upper side of the mandrel 36. Plural roller pairs 50 (for example, 3 pairs) are provided, and the rollers on the one (left side in the drawing) of the sides of the roller pairs 50 are connected to the drive roller 54 through a belt 52. When the drive roller 54 is driven, the core metal 22 held between each of the roller pairs 50 is transported to the passage hole 46 of the mandrel 36. The core metal 22 has a predetermined length, and a rear core metal 22 transported by the roller pairs 50 pushes a front core metal 22 present in the passage hole 46 of the mandrel 36 so that plural core metals 22 are sequentially passed through the passage hole 46.

In the core metal transport part 24, the core metal 22 is transported downward in the vertical direction by the roller pairs 50. The driving of the drive roller 54 which drives the roller pairs 50 is once stopped when the front end of the front core metal 22 reaches the front end of the mandrel 36. Then, in the joint region 48, the rubber material 100 is cylindrically extruded, and the core metals 22 are sequentially transported at intervals into the central portion of the rubber material 100. Thus, the discharge head 38 alternately discharges a rubber roller part 56, in which the outer peripheral surface of the core metal 22 is coated with the rubber material, and a hollow part 58 between the core metals 22, in which the rubber material 100 is hollow inside. The outer peripheral surface of the core metal 22 may be previously coated with a primer (adhesive layer) in order to enhance the adhesion to the rubber material 100.

[Separator]

The separator 14 is provided with a pair of semi-cylindrical separating members 60. The separating members 60 are disposed to face each other so that the rubber roller part 56 discharged from the extruder 12 is held therebetween. Also, a projecting part 62 projecting toward a central portion is formed on each of the separating members 60. In addition, each of the separating members 60 can be moved in the lateral direction of the drawing by a drive mechanism (not shown) so as to separate between a front rubber roller part 56 and a rear rubber roller part 56. Thus, a bag-like closed rubber roller body (not shown) containing the front core metal 22 is formed.

[Drawer Derive]

The drawer derive 16 has a pair of semi-cylindrical gripping members 64. The gripping members 64 are disposed to face each other so that the rubber roller part 56 discharged from the extruder 12 is held therebetween. Also, a gripping part 66 having a shape corresponding to the shape of the outer peripheral surface of the rubber roller part 56 is formed on each of the gripping members 64. In addition, each of the gripping members 64 can be moved in the lateral direction and the vertical direction by a drive mechanism (not shown).

If required, the bag-like closed rubber roller body produced by the apparatus 10 for producing the rubber roller described above is placed in a vulcanization furnace. Thus, the rubber material 100 which covers the core metal 22 is vulcanized.

Then, the rubber material 100 is cut out from both ends of the vulcanized rubber roller body so that the core metal 22 is exposed over a certain length on the both end sides in the axial direction. That is, the rubber material 100 which covers each of the ends of the core metal 22 is cut out. Therefore, a rubber roller (a member including the conductive substrate and the elastic layer formed thereon) is produced.

Then, if required, the surface layer is formed on the elastic layer of the rubber roller (a member including the conductive substrate and the elastic layer formed thereon), thereby producing the charging member.

The surface layer is formed by, for example, applying a coating solution prepared by dissolving or dispersing the components in a solvent on the conductive substrate (the outer peripheral surface of the elastic layer) using an immersion method, a blade coating method, a spray method, a vacuum vapor deposition method, a plasma coating method, or the like, and then drying the formed coating film.

A method for adjusting the maximum amplitude value As within the period region of less than 5 mm in analysis of the circumferential direction period of the surface shape of the surface layer is, for example, a method for adjusting As by properly adjusting the type of the resin, the particle diameter and content of the particles contained, the thickness of the surface layer, the viscosity of a coating material for the surface layer, the surface tension of the coating film, etc.

[Image Forming Apparatus/Charging Device/Process Cartridge]

An image forming apparatus according to an exemplary embodiment of the present invention includes an image holding member, a charging device which charges the surface of the image holding member, an exposure device which forms a latent image by exposing the charged surface of the image holding member, a developing device which forms a toner image by developing the latent image formed on the surface of the image holding member with a toner, and a transfer device which transfers the toner image formed on the surface of the image holding member to a recording medium. The charging device used is a charging device (a charging device according to an exemplary embodiment of the present invention) including the charging member according to the exemplary embodiment as a charging device, the charging member being disposed in contact with the surface of the image holding member.

On the other hand, a process cartridge according to an exemplary embodiment of the present invention is, for example, detachable from the image forming apparatus having the configuration described above and includes an image holding member and a charging device and which charges the surface of the image holding member. The charging device according to the exemplary embodiment is applied to the charging device.

If required, the process cartridge according to the exemplary embodiment may include, for example, at least one selected from the group including an exposure device which forms a latent image by exposing the charged surface of the image holding member, a developing device which forms a toner image by developing the latent image formed on the surface of the image holding member with a toner, a transfer device which transfers the toner image formed on the surface of the image holding member to a recording medium, and a cleaning device which cleans the surface of the image holding member.

In the image forming apparatus and process cartridge according to the exemplary embodiment, the exposure device may be an exposure device using a light-emitting diode as a light source. In addition, the image holding member, the charging member, and the exposure device may be integrally held in a housing.

An example of the exposure device using a light-emitting diode as a light source is an exposure device including a mounting substrate on which mounted are a light-emitting diode array in which light-emitting diodes are arranged along the axial direction of the image holding member, and a circuit which drives the light-emitting diodes, and a connecting part for forming an image on the surface of the image holding member by using light emitted from the light-emitting diodes.

A specific example of the exposure derive is a self-scanning LED print head including a mounting substrate on which mounted are an light-emitting part (light-emitting thyristor) having plural thyristor structures, in each of which a light-emitting diode array and a drive part therefor are integrated, and a circuit which controls the drive of the light-emitting diode array, and a rod lens array serving as an image forming part (for example, a Selfoc lens array (Selfoc: registered tradename of Nippon Sheet Glass Company, Ltd.).

Next, the image forming apparatus and the process cartridge according to the exemplary embodiment are described with reference to the drawings.

Figure 3:
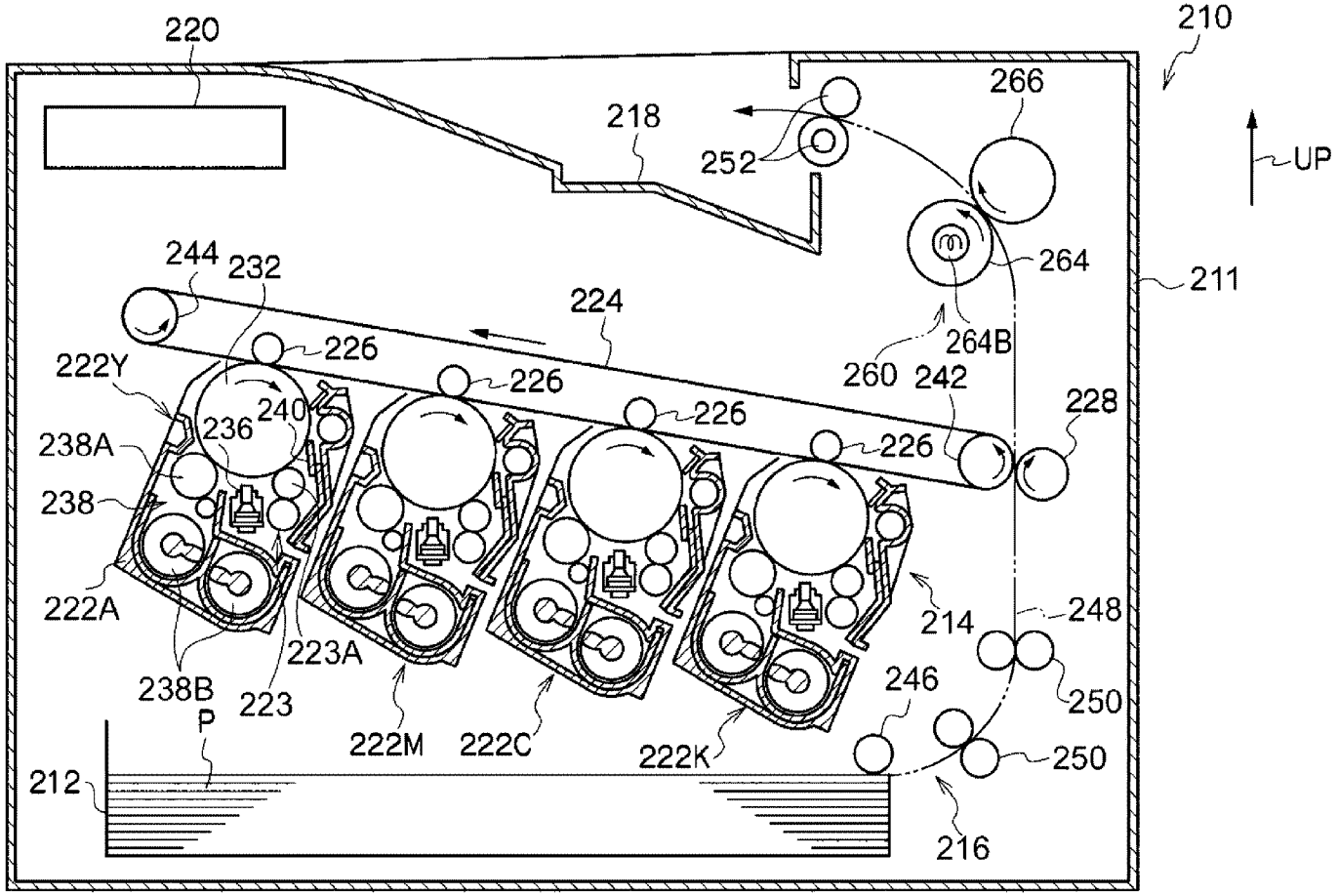
FIG. 3 is a schematic configuration diagram showing an image forming apparatus according to the exemplary embodiment.

FIG. 3 is a schematic configuration diagram showing the image forming apparatus according to the exemplary embodiment. In the figure, an arrow "UP" indicates an upper portion in the vertical direction.

As shown in FIG. 3, an image forming apparatus 210 includes an image forming apparatus body 211 in which components are housed. In the image forming apparatus body 211, provided are a housing part 212 which houses a recording medium P such as paper or the like, an image forming part 214 which forms an image on the recording medium P, a transport part 216 which transports the recording medium P from the housing part 212 to the image forming part 214, and a controller 220 which controls the operation of each of the parts of the image forming apparatus 210. Also, a discharge part 218 to which the recording medium P having an image formed by the image forming part 214 is discharged is provided in an upper portion of the image forming apparatus body 211.

The image forming part 214 includes image forming units 222Y, 222M, 222C, and 222K (referred to as "222Y to 222K" hereinafter) which form toner images of colors of yellow (Y), magenta (M), cyan (C), and black (K), respectively, an intermediate transfer belt 224 to which the toner images formed in the image forming units 222Y to 222K are transferred, first transfer rollers 226 which transfer the toner images formed by the image forming units 222Y to 222K to the intermediate transfer belt 224, and a second transfer roller 228 which transfers the toner images, which have been transferred to the intermediate transfer belt 224 by the first transfer rollers 226, from the intermediate transfer belt 224 to the recording medium P. The image forming part 214 is not limited to the configuration described above and may have another configuration as long as an image is formed on the recording medium P.

A unit including the intermediate transfer belt 224, the first transfer rollers 226, and the second transfer roller 228 corresponds to an example of the transfer device.

The image forming units 222Y to 222K are arranged in a state inclined from the horizontal direction so as to line up in a vertical direction central portion of the image forming apparatus 210. Each of the image forming units 222Y to 222K has a photoreceptor 232 (an example of the image holding member) which rotates in a direction (for example, the clockwise direction in FIG. 3). The image forming units 222Y to 222K have the same configuration and thus, in FIG. 3, the reference numerals of the parts of each of the image forming units 222M, 222C, and 222K are omitted.

Around each of the photoreceptors 232, there are provided, in order from the upstream side in the rotational direction of the photoreceptor 232, a charging device 223 including a charging roller 223A which charges the photoreceptor 232, an exposure device 236 which forms a latent image on the photoreceptor 232 by exposure of the photoreceptor 232 charged by the charging device 223, a developing device 238 which develops the latent image formed on the photoreceptor 232 by the exposure device 236 to form a toner image, and a removing member (a cleaning blade or the like) 240 which is in contact with the photoreceptor 232 and removes the toner remaining on the photoreceptor 232.

The photoreceptor 232, the charging device 223, the exposure device 236, the developing device 238, and the removing member 240 are integrally held by a housing 222A to form a cartridge (process cartridge).

A self-scanning LED print head is applied to the exposure device 236. The exposure device 236 may be an exposure device of an optical system in which the photoreceptor 232 is exposed by a light source through a polygon mirror.

The exposure device 236 forms a latent image based on an image signal sent from the controller 220. The image signal sent from the controller 220 is, for example, an image signal acquired from an external device by the controller 220.

The developing device 238 includes a developer supply body 238A which supplies the developer to the photoreceptor 232 and plural transport members 238B which transport, while stirring, the developer added to the developer supply body 238A.

The intermediate transfer belt 224 is formed in a circular shape and disposed above the image forming units 222Y to 222K. The intermediate transfer belt 224 is wound on winding rolls 242 and 244 provided on the inner side of the intermediate transfer belt 224. When any one of the winding rolls 242 and 244 is rotationally driven, the intermediate transfer belt 224 circularly moves (rotates) in a direction (for example, the counter-clockwise direction in FIG. 3) while being in contact with the photoreceptors 232. The winding roll 242 is a counter roll facing the second transfer roller 228.

The first transfer roller 226 faces each of the photoreceptors 232 with the intermediate transfer belt 224 disposed therebetween. The space between the first transfer roller 226 and each of the photoreceptors 232 serves as a first transfer position where the toner image formed on each of the photoreceptors 232 is transferred to the intermediate transfer belt 224.

The second transfer roller 228 faces the winding roll 242 with the intermediate transfer belt 224 disposed therebetween. The space between the second transfer roller 228 and the winding roll 242 serves as a second transfer position where the toner images transferred to the intermediate transfer belt 224 are transferred to the recording medium P.

The transport part 216 includes a delivery roller 246 which delivers the recording medium P housed in the housing part 212, a transport path 248 through which the recording medium P delivered by the delivery roller 246 is transported, and plural transport rollers 250 which are disposed along the transport path 248 to transport the recording medium P delivered by the deliver roller 246 to the second transfer position.

Further, a fixing device 260 which fixes the toner image formed on the recording medium P by the image forming part 214 to the recording medium P is provided on the downstream side of the second transfer position in the transport direction.

The fixing device 260 includes a heating roller 264 which heats the image on the recording medium P and a pressure roller 266 as an example of a pressure member. A heating source 264B is provided in the heating roller 264.

Further, a discharge roller 252 which discharges the recording medium P having the toner image fixed thereto to the discharge part 218 is provided on the downstream side of the fixing device 260 in the transport direction.

Next, the image forming operations of forming an image on the recording medium P in the image forming apparatus 210 are described.

In the image forming apparatus 210, the recording medium P delivered from the housing part 212 by the delivery roller 246 is sent to the second transfer position by the plural transport rollers 250.

In each of the image forming units 222Y to 222K, the photoreceptor 232 charged by the charging device 223 is exposed by the exposure device 236 to form a latent image on the photoreceptor 232. The latent image is developed by the developing device 238 to form a toner image on the photoreceptor 232. The toner images of respective colors formed in the image forming units 222Y to 222K are superposed on the intermediate transfer belt 224 at the first transfer positions, forming a color image. The color image formed on the intermediate transfer belt 224 is transferred to the recording medium P at the second transfer position.

The recording medium P to which the toner images have been transferred is transported to the fixing device 260, and the transferred toner images are fixed by the fixing device 260. The recording medium P on which the toner images have been fixed is discharged to the discharge part 218 by the discharge roller 252. A series of image forming operations is performed as described above.

The image forming apparatus 210 according to the exemplary embodiment is not limited to the configuration described above, and examples which may be applied include known image forming apparatuses such as an image forming apparatus of a direct transfer system in which the toner images formed on the photoreceptors 232 of the image forming units 222Y to 222K are transferred directly to the recording medium P, and the like.

EXAMPLES

The present invention is described in further detail below based on examples. However, the present invention is not limited to these examples. In description below, "parts" represents "parts by weight" unless otherwise specified.

Example 1

(Production of Rubber Roller (Formation of Elastic Layer))

A rubber roller is produced by using a "60 mm single-screw vent rubber extruder" manufactured by Mitsuba Mfg. Co., Ltd. corresponding to the rubber roller producing apparatus shown in FIGS. 4 to 9. Specifically, a SUS303-made core metal having a diameter of 8 mm and a length of 330 mm is prepared, and a rubber material having a composition described below is extruded in a cylindrical shape from the extrusion part of the rubber roller producing apparatus set as described below. The core metal is supplied into the central portion of the extruded rubber material to coat the outer peripheral surface of the core metal with the cylindrical rubber material. Then, an unvulcanized rubber roller including the core metal whose outer peripheral surface is coated with the rubber material is vulcanized by an air heating furnace at 160° C. for 60 minutes. As a result, a rubber roller having an outer diameter of 12.00 mm is produced, in which the outer peripheral surface of the core metal (conductive substrate) is coated with the vulcanized rubber material (elastic layer).

(Rubber Material)

Rubber: epichlorohydrin rubber (trade name: EPION301, company name: Osaka Soda Co., Ltd.) 100 pasts by weight Processing aid: stearic acid (trade name: TSUBAKI, company name: NOF Corporation) 1 part by weight Carbon black (trade name: 3030B, company name: Mitsubishi Chemical Corporation) 6 parts by weight Calcium carbonate (trade name: VISCOEXCEL-30, company name: Shiraishi Kogyo Kaisha) 40 parts by weight Plasticizer: paraffin oil (trade name: DB02, company name: Osaka Soda Co., Ltd.) 3 parts by weight Vulcanizing agent: (trade name: Sanfel R, company name; Sanshin Chemical Industry Co., Ltd.) 2 parts by weight Vulcanization accelerator 1: (trade name: NOCCELER DM: company name: Ouchi Shinko Chemical Industrial Co., Ltd.) 2.5 parts by weight Vulcanization accelerator 2: (trade name: NOCCELER TET: company name: Ouchi Shinko Chemical Industrial Co., Ltd.) 1 part by weight Vulcanization aid: (trade name: zinc oxide type II, company name: Seido Chemical Industry Co., Ltd.) 5 parts by weight The rubber material containing the components described above is kneaded by using a closed kneading machine and a roll machine to produce the unvulcanized rubber material.

(Conditions of Rubber Roller Producing Apparatus)

—Basic Conditions—

Cylindrical body part (cylinder): length Ls=1,200 mm, inner diameter ID=60 mm, Ls/ID=20

Number of rotations of screw: 16 rpm

Extrusion pressure: 23 MPa

Core metal: whole length=350 mm, outer diameter ϕ=8.0 mm

Discharge head diameter (die diameter): ϕ 12.5 mm

Mandrel (refer to FIGS. 4 to 9): separation distance K2 from the inlet-side convex surface 126 of the mandrel 36 to the inner peripheral surface 42A=0.6 D mm, separation distance K3 from each of the side convex surfaces 128 to the inner peripheral surface 42A=0.8 D mm, separation distance K from the groove bottom 122A of each of the grooves 122 to the inner peripheral surface 42A=1.2 D mm, ratio L1:L2 of the length L1 of the base end part 112 of the mandrel 36 to the length L2 of the front end part 114=4:6

Discharge head temperature (die temperature): 90° C.

(Formation of Surface Layer)

Binder resin: 100 parts by weight (N-methoxymethylated nylon, trade name FR-101, manufactured by Namariichi Co., Ltd.)

Particle A: 15 parts by weight (carbon black, trade name: MONAHRCH 1000, manufactured by Cabot Corporation)

Particle B: 20 parts by weight (polyamide resin particle, Polyamide 12, manufactured by Alkema Inc.)

Additive: 1 part by weight (dimethyl polysiloxane, BYK-307, manufactured by Altana Inc.)

A mixture having the composition described above is diluted with methanol and dispersed by using a bead mill to prepare a dispersion liquid. The resultant dispersion liquid is applied on the surface of the rubber roller by immersion and is then dried by heating at 130° C. for 30 minutes, thereby forming a surface layer having a thickness of 16 μm. As a result, a charging member (charging roller) of each of the examples is produced.

<Evaluation>

The resultant charging member (charging roller) produced in each of the examples is evaluated as follows. The results are shown in Table 1.

(Specification of Surface Shapes of Elastic Layer and Surface Layer of Charging Member)

In analysis of the circumferential direction period of the surface shape of the surface layer of the charging member, the maximum amplitude value within a period region of less than 5 mm is measured according to the method described above.

Also, the surface layer of the charging member is removed by using methanol as a solvent and BEMCOT AZ-8 (manufactured by Asahi Kasei Corporation), and in analysis of the circumferential direction period of the shape of the elastic layer of the charging member, the maximum amplitude value within a period region of less than 5 mm is measured according to the method described above.

The measurement results are shown in Table 1.

(Density Unevenness of Image)

The charging member produced in each of the examples is mounted on ApeosPort-VI C771 manufactured by Fuji Xerox Co., Ltd. (an apparatus in which a photoreceptor, a charging member, a self-scanning LED print head as an exposure device, a developing device, and a cleaning blade are integrally held in a housing to form a cartridge).

Then, an image is output on A3-side P paper (manufactured by Fuji Xerox Co., Ltd.) by using the apparatus under the conditions including a white-and-black mode, an entire surface halftone, and an image density of 600, and the grade of density unevenness of the image is evaluated. The grade is evaluated in increments of 0.5 from G0 to G5, and a smaller numeral of G indicates a lower degree of occurrence of image unevenness. An acceptable grade of density unevenness is G3.5.

The evaluation results are shown in Table 1.

Example 2

A charging member of Example 2 is produced by the same method as in Example 1 except that among the conditions of the rubber roller producing apparatus, the mandrel conditions include separation distance K2=0.7 D mm, separation distance K3=0.7 D mm, separation distance K=1.0 D mm, and ratio L1:L2=4:6, and the breaker plate conditions includes a hole outer diameter ϕ of 1.0 mm and a number of holes of 90. The charging member is evaluated by the same method as in Example 1.

Example 3

A charging member of Example 3 is produced by the same method as in Example 2 except that in forming a surface layer, the amount of particles B mixed as polyamide resin particles is changed to 10 parts by weight. The charging member is evaluated by the same method as in Example 1.

Example 4

A charging member of Example 4 is produced by the same method as in Example 1 except that a surface layer is formed in a thickness of 13 μm. The charging member is evaluated by the same method as in Example 1.

Example 5

A charging member of Example 5 is produced by the same method as in Example 2 except that a surface layer is formed in a thickness of 13 μm. The charging member is evaluated by the same method as in Example 1.

Example 6

A charging member of Example 6 is produced by the same method as in Example 1 except that in forming a surface layer, the amount of particles B mixed as polyamide resin particles is changed to 30 parts by weight. The charging member is evaluated by the same method as in Example 1.

Example 7

A charging member of Example 7 is produced by the same method as in Example 1 except that the rubber material and vulcanizing agent mixed in the elastic layer are changed to 100 parts by weight of epichlorohydrin rubber (trade name: EPICHROMER CG102, company name: Osaka Soda Co., Ltd.) and 1 part by weight of a vulcanizing agent (trade name: Sanfel R, company name; Sanshin Chemical Industry Co., Ltd.), respectively. The charging member is evaluated by the same method as in Example 1.

Comparative Example 1

A charging member of Comparative Example 1 is produced by the same method as in Example 1 except that in forming a surface layer, particles B are not mixed as polyamide resin particles, and the surface layer is formed in a thickness of 10 μm. The charging member is evaluated by the same method as in Example 1.

Comparative Example 2

A charging member of Comparative Example 2 is produced by the same method as in Example 2 except that in forming a surface layer, particles B are not mixed as polyamide resin particles, and the surface layer is formed in a thickness of 10 μm. The charging member is evaluated by the same method as in Example 1.

TABLE 1

| | As (μm) | Ae (μm) | As/Ae | Hs (MD-1 Hardness) | He (MD-1 Hardness) | Hs/He | Density unevenness (Grade) |
|---|---|---|---|---|---|---|---|
| Example 1 | 0.51 | 0.66 | 0.77 | 58 | 44 | 1.32 | G1.5 |
| Example 2 | 0.73 | 0.90 | 0.81 | 58 | 44 | 1.32 | G2 |
| Example 3 | 0.73 | 0.90 | 0.81 | 55 | 44 | 1.25 | G2.5 |
| Example 4 | 0.56 | 0.66 | 0.85 | 58 | 44 | 1.32 | G3 |
| Example 5 | 0.79 | 0.90 | 0.88 | 58 | 44 | 1.32 | G3.5 |
| Example 6 | 0.51 | 0.66 | 0.77 | 60 | 44 | 1.36 | G1.5 |
| Example 7 | 0.51 | 0.66 | 0.77 | 58 | 40 | 1.45 | G1.5 |
| Comparative Example 1 | 0.62 | 0.66 | 0.94 | 52 | 44 | 1.18 | G4 |
| Comparative Example 2 | 0.88 | 0.90 | 0.98 | 52 | 44 | 1.18 | G4.5 |

The above results indicate that the charging members (charging rollers) of the examples show suppressed density unevenness of the obtained images as compared with the charging members (charging rollers) of the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a cylindrical or columnar conductive substrate;

an elastic layer provided on the conductive substrate; and a surface layer provided on the elastic layer, wherein when in analysis of a circumferential direction period of a surface shape of the elastic layer, a maximum amplitude value in a period region of less than 5 mm is Ae, and when in analysis of a circumferential direction period of a surface shape of the surface layer, a maximum amplitude value in the period region of less than 5 mm is As, the charging member satisfies $As/Ae \leq 0.9$.

2. The charging member according to claim 1, wherein an MD-1 hardness of the elastic layer in a state wherein the elastic layer is provided on the conductive substrate is He, and an MD-1 hardness of the surface layer in a state where the elastic layer and the surface layer are provided in turn on the conductive substrate is Hs, $Hs/He \geq 1.2$ is satisfied.

3. The charging member according to claim 2, wherein the He and Hs satisfy $Hs/He \geq 1.3$.

4. The charging member according to claim 2, wherein the He and Hs satisfy $1.5 \geq Hs/He \geq 1.2$.

5. The charging member according to claim 1, wherein a value of Ae is 0.3 μm or more and 1.0 μm or less.

6. The charging member according to claim 5, wherein the value of Ae is 0.6 μm or more and 0.9 μm or less.

7. The charging member according to claim 1, wherein a value of As is 0.2 μm or more and 0.9 μm or less.

8. The charging member according to claim 7, wherein the value of As is 0.5 μm or more and 0.8 μm or less.

9. The charging member according to claim 2, wherein a value of He is 30 or more and 50 or less.

10. The charging member according to claim 9, wherein the value of He is 40 or more and 50 or less.

11. The charging member according to claim 2, wherein a value of Hs is 40 or more and 80 or less.

12. The charging member according to claim 11, wherein the value of Hs is 55 or more and 65 or less.

13. A charging device comprising the charging member according to claim 1.

14. A process cartridge detachable from an image forming apparatus, the process cartridge comprising:

an image holding member; and a charging device that charges a surface of the image holding member and includes the charging member according to claim 1, the charging member being disposed in contact with the surface of the image holding member.

15. An image forming apparatus comprising:

an image holding member;

a charging device that charges a surface of the image holding member and includes the charging member according to claim 1, the charging member being disposed in contact with the surface of the image holding member;

an exposure device that forms a latent image by exposing the charged surface of the image holding member;

a developing device that forms a toner image by developing the latent image formed on the surface of the image holding member with a toner; and a transfer device that transfers the toner image formed on the surface of the image holding member to a recording medium.

* * * * *